US006871608B2

(12) United States Patent
Rosen

(10) Patent No.: US 6,871,608 B2
(45) Date of Patent: Mar. 29, 2005

(54) TWIN HULL PERSONAL WATERCRAFT

(76) Inventor: Yoav Rosen, 41 Fernwood Rd., Newton, MA (US) 02465

( * ) Notice: Subject to any disclaimer, the term of this patent is extended or adjusted under 35 U.S.C. 154(b) by 0 days.

(21) Appl. No.: 10/715,739

(22) Filed: Nov. 18, 2003

(65) Prior Publication Data

US 2004/0112266 A1 Jun. 17, 2004

Related U.S. Application Data

(60) Provisional application No. 60/427,726, filed on Nov. 20, 2002.

(51) Int. Cl.[7] ..... B63B 1/00

(52) U.S. Cl. ..... 114/61.1; 114/347

(58) Field of Search ..... 114/61.1, 347, 114/61.22, 58, 354, 357

(56) References Cited

U.S. PATENT DOCUMENTS

| | | | | |
|---|---|---|---|---|
| 22,457 A | | 12/1858 | Rowlands | 441/76 |
| 216,234 A | | 6/1879 | Soule | 441/77 |
| 579,695 A | | 3/1897 | Carmina-Morreale | 441/77 |
| 1,006,118 A | | 10/1911 | Napier | 440/19 |
| 1,384,354 A | | 7/1921 | Sheldon | 441/77 |
| 1,443,133 A | | 1/1923 | Kelley | 441/77 |
| 1,475,031 A | | 11/1923 | Sheldon | 441/77 |
| 1,487,368 A | | 3/1924 | Berka | 114/283 |
| 1,586,458 A | | 5/1926 | Newby | 114/283 |
| 1,692,055 A | | 11/1928 | Sheldon | 441/77 |
| 1,719,059 A | | 7/1929 | Krupka et al. | 441/77 |
| 2,153,939 A | | 4/1939 | Schaupp | 441/77 |
| 2,577,917 A | | 12/1951 | Root | 441/76 |
| 2,694,209 A | | 11/1954 | Lipincott | 441/77 |
| 3,084,356 A | | 4/1963 | Wheat | 441/77 |
| 3,087,455 A | | 4/1963 | Collier | 440/19 |
| 3,112,504 A | | 12/1963 | Carlton | 441/77 |
| 3,121,892 A | | 2/1964 | Plumlee | 441/77 |
| 3,194,206 A | | 7/1965 | Anderson | 440/19 |
| 3,256,850 A | | 6/1966 | Bramson | 416/82 |
| 3,369,517 A | | 2/1968 | Rosenthal | 440/25 |
| 3,605,676 A | | 9/1971 | Spangenberg | 115/21 |
| 3,609,782 A | | 10/1971 | Mabuchi | 9/310 D |
| 3,621,500 A | | 11/1971 | Senghas | 9/310 D |
| 3,714,921 A | | 2/1973 | Gibson | 115/28 R |
| 3,757,729 A | | 9/1973 | Golden | 115/28 |
| 3,790,977 A | * | 2/1974 | Bombardier et al. | 114/357 |
| 3,874,319 A | | 4/1975 | Martin et al. | 115/23 |

(Continued)

FOREIGN PATENT DOCUMENTS

| | | | |
|---|---|---|---|
| DE | 2249316 | 4/1974 | 114/315 |
| DE | 3331049 A | 4/1985 | |
| DE | 3431659 A1 | 3/1986 | B63H/16/18 |

(Continued)

OTHER PUBLICATIONS

Office action dated Apr. 23, 2003, for U.S. Appl. No. 10/201,066, now U.S. patent No. 6,764,363, Rosen.

(Continued)

*Primary Examiner*—Lars A. Olson
(74) *Attorney, Agent, or Firm*—Inna Landsman

(57) ABSTRACT

The invention provides a watercraft for transporting one or more human users in any of a sitting, standing, riding, kneeling or recumbent positions. The watercraft includes (a) a first hull comprising a cavity extending from the top of the hull downwards substantially to the bottom of said hull, said cavity being sufficiently wide to accommodate a user's leg and foot when the user is in a sitting, standing, riding, or kneeling position, (b) a second hull comprising a cavity extending from the top of the hull downwards substantially to the bottom of said hull, said cavity being sufficiently wide to accommodate a user's leg and foot when the user is in a sitting, standing, riding, or kneeling position, and (c) a connector rigidly attached to each of the first and second hulls, wherein a user of the watercraft can sit, ride, kneel, or stand with one foot and/or leg in the cavity of each hull.

22 Claims, 6 Drawing Sheets

U.S. PATENT DOCUMENTS

| | | | | | |
|---|---|---|---|---|---|
| 3,970,031 | A | | 7/1976 | Vrana | 115/21 |
| 4,034,430 | A | | 7/1977 | Joyce | 9/310 D |
| 4,060,866 | A | | 12/1977 | Robinson | 9/310 D |
| 4,117,562 | A | | 10/1978 | Schaumann | 9/310 D |
| 4,129,912 | A | | 12/1978 | Robinson | 9/310 D |
| 4,157,597 | A | | 6/1979 | Trebnick | 9/310 D |
| 4,261,069 | A | | 4/1981 | Schaumann | 9/310 D |
| 4,295,236 | A | * | 10/1981 | Upchurch | 114/357 |
| 4,318,700 | A | * | 3/1982 | Price | 114/61.22 |
| 4,353,703 | A | | 10/1982 | d'Elloy | 440/21 |
| 4,365,570 | A | | 12/1982 | Jamieson | 114/39 |
| 4,496,325 | A | | 1/1985 | Tweg | 440/26 |
| 4,591,343 | A | | 5/1986 | Schaumann | 441/76 |
| 4,621,587 | A | | 11/1986 | Pool | 114/61 |
| 4,624,209 | A | * | 11/1986 | Loffler | 114/354 |
| 4,698,039 | A | | 10/1987 | Watson | 441/77 |
| 4,952,184 | A | | 8/1990 | Graziano | 441/77 |
| 5,080,621 | A | | 1/1992 | Nayes | 441/77 |
| 5,120,249 | A | | 6/1992 | Fonda | 441/77 |
| 5,127,855 | A | | 7/1992 | Heywood | 440/14 |
| 5,189,974 | A | * | 3/1993 | Masters | 114/347 |
| 5,192,237 | A | | 3/1993 | Pegoraro | 441/76 |
| 5,236,381 | A | | 8/1993 | Keogh | 441/77 |
| 5,417,179 | A | | 5/1995 | Niemer et al. | 114/347 |
| 5,421,759 | A | | 6/1995 | Morin | 441/77 |
| 5,462,466 | A | | 10/1995 | Hull et al. | 441/76 |
| 5,529,008 | A | * | 6/1996 | Craig | 114/61.1 |
| 5,593,334 | A | | 1/1997 | Thayer | 441/77 |
| 5,649,498 | A | | 7/1997 | Zigurs | 114/61 |
| 5,657,713 | A | * | 8/1997 | Rowlett | 114/61.1 |
| 5,697,822 | A | | 12/1997 | Souter | 441/76 |
| D401,546 | S | | 11/1998 | Boris et al. | D12/304 |
| 5,860,378 | A | | 1/1999 | Schaller | 114/39.1 |
| 5,860,841 | A | | 1/1999 | Welz | 441/76 |
| 5,896,825 | A | | 4/1999 | Trefethen | 114/39.28 |
| 6,095,073 | A | | 8/2000 | Burkett | 114/61.1 |
| 6,112,692 | A | | 9/2000 | Lekhtman | 114/347 |
| 6,138,602 | A | | 10/2000 | Cary | 114/288 |
| 6,289,838 | B2 | | 9/2001 | Dust | 114/347 |
| 6,468,118 | B1 | | 10/2002 | Chen | 440/21 |
| 6,526,903 | B2 | | 3/2003 | Robinson et al. | 114/288 |
| 6,764,363 | B2 | | 7/2004 | Rosen | 441/77 |
| 2003/0017769 | A1 | | 1/2003 | Rosen | 441/76 |

FOREIGN PATENT DOCUMENTS

| | | | |
|---|---|---|---|
| DE | 3441589 A1 | 5/1986 | A63B/35/00 |
| DE | 8907360 U | 8/1989 | |
| DE | 3902367 A1 | 8/1990 | B63H/11/06 |
| GB | 2212467 A | 7/1989 | B63H/1/30 |
| NL | 8401176 | 11/1985 | 441/64 |

OTHER PUBLICATIONS

Office action dated Sep. 9, 2003 for U.S. Appl. No. 10/201,066, now U.S. patent No. 6,764,363, Rosen.

W. L. Robinson, The Art of Walking on Water—An Introduction to the Stand–Up Paddle Boat, U.S. 1995, SS# 073551253, pp. 141–142: p. # I–41: Inflatable water shoes used with double–blade paddle / H. Mitchell, 1984, U.K.; p. # I–42: Polyester floats strapped to feet used with double–blade paddle/ R. Bricka, 1988, France.

Kwik Kayak Angler Web site (http://www.kiwikayak.com/angler.htm).

Yoav Rosen, Speed Fundamentals and the Twinhull Advantages Article (published approximately Mar. 2003).

Yoav Rosen, Speed Fundamentals and the Twinhull Advantages Article (revised between Mar. 2003 and Mar. 2004).

Search report for PCT/US 03/37034 (4 pages including patent family search page).

Author unknown, *2 El hombre como agente cultural y factor de cambio del medio ambiente*, published at http://www-.pro–ohiggins.cl/libro/cuerpo/2_2_1.asp. Applicant admits it as prior art. (7 page print–out submitted).

Author unknown, *Changos*, published at http://www.profesorenlinea.cl/chilehistoria/Changos.htm. Applicant admits it as prior art. (2 page print–out submitted).

* cited by examiner (inches)

TWIN HULL PERSONAL WATERCRAFT

CROSS-REFERENCE TO RELATED APPLICATIONS

This application claims priority to provisional application Ser. No. 60/427,726, entitled "Dual hull personal watercraft", having a filing date of Nov. 20, 2002, which is hereby incorporated by reference.

STATEMENT REGARDING FEDERALLY SPONSORED RESEARCH OR DEVELOPMENT

Not applicable

REFERENCE TO COMPACT DISK APPENDIX

Not applicable

BACKGROUND OF THE INVENTION

Previous human-powered aquatic apparatuses have been proposed or built, ranging from common watercraft like canoes, rowboats, paddleboats, and kayaks, in which the human sits or kneels, to more unusual craft like the "Pogo-foil" U.S. Pat. No. 6,468,118.

Canoes and kayaks are examples of watercraft used for seated paddling (as differentiated from rowing). Both kayaks and canoes are shallow draft, relatively flat-bottomed mono-hull watercraft known for their poor stability and user discomfort. In both watercraft the user typically is seated (or kneeling) below the top edge of the hull in an attempt to increase stability, a position that causes increased user discomfort. Standing in either of these watercraft is highly discouraged because of their poor stability. Both watercraft can be made to be highly maneuverable and the kayak in particular can be designed for high speed. Generally speaking, kayaks are differentiated from canoes by the position taken during paddling; in a kayak the user sits on a generally flat surface with the legs extended forward at an approximate 90 degree angle relative to the spine.

Several inventors have developed so-called "sit-on-top" kayaks. These watercraft typically comprise a shallow draft hull with a low top edge or surface and a relatively broad wetted beam. A user seat is disposed on or slightly depressed into the top surface. The major advantage of this type of watercraft is that the user does not have the feeling of confinement of a standard kayak and often feels more comfortable being able to hold the paddle with a lower arm position. This watercraft also feels more stable because of its wider wetted beam. These watercraft are called "kayaks" because the user seat is configured to force the user to sit in the fashion of a classical kayaker—legs extended forward at an approximate 90 degree angle relative to the spine. These watercraft are not stable enough to be paddled while standing and, as the name suggests, retain the non-ergonomic seating position. One sit-on-top kayak is sold under the trade name Rotonics Funyak™ by Rotonics Manufacturing, Inc., 17022 So. Figeroa St., Gardena, Calif. 90248.

Other human powered aquatic apparatuses have attempted to take advantage of the generally improved stability provided by twin hulls. Some examples of these devices include a mechanism by which a pair of specialized kayak-like watercraft are yoked to form a dual rider "kayak catamaran", U.S. Pat. No. 5,189,974, and a "dual hull kayak" U.S. Pat. No. 6,112,692, in which the rider sits on a bridging platform, with legs outstretched in a classic kayak position, or U.S. Pat. No. 5,649,498, in which low chairs have been installed on top of a connecting frame. Yet other inventors have designed mechanisms for yoking together pairs of common canoes, U.S. Pat. No. 5,657,713, or kayak-like hulls, U.S. Pat. No. 4,621,587, the resulting watercraft typically being propelled by sail.

There is, however, a need for a human powered, paddled watercraft that is both stable and comfortable and has high speed and maneuverability capabilities. Additionally, the watercraft should be usable in a wide variety of positions, including a seated, standing, recumbent, riding, and kneeling position. The watercraft should be very stable for both comfort and safety, and should allow the user to easily balance himself using his legs since humans intuitively do so. Furthermore, the watercraft should be lightweight for easy transport on land and, desirably, should be adaptable to different uses and users. These and other needs are met through the various embodiments of the present invention discussed below.

BRIEF DESCRIPTION OF THE SEVERAL VIEWS OF THE DRAWINGS

The foregoing and other objects, features and advantages of the invention will become apparent from the following description in conjunction with the accompanying drawings. The drawings are not necessarily to scale; emphasis has instead been placed upon illustrating the principles of the invention. Of the drawings.

SUMMARY OF THE INVENTION

Figure 1:
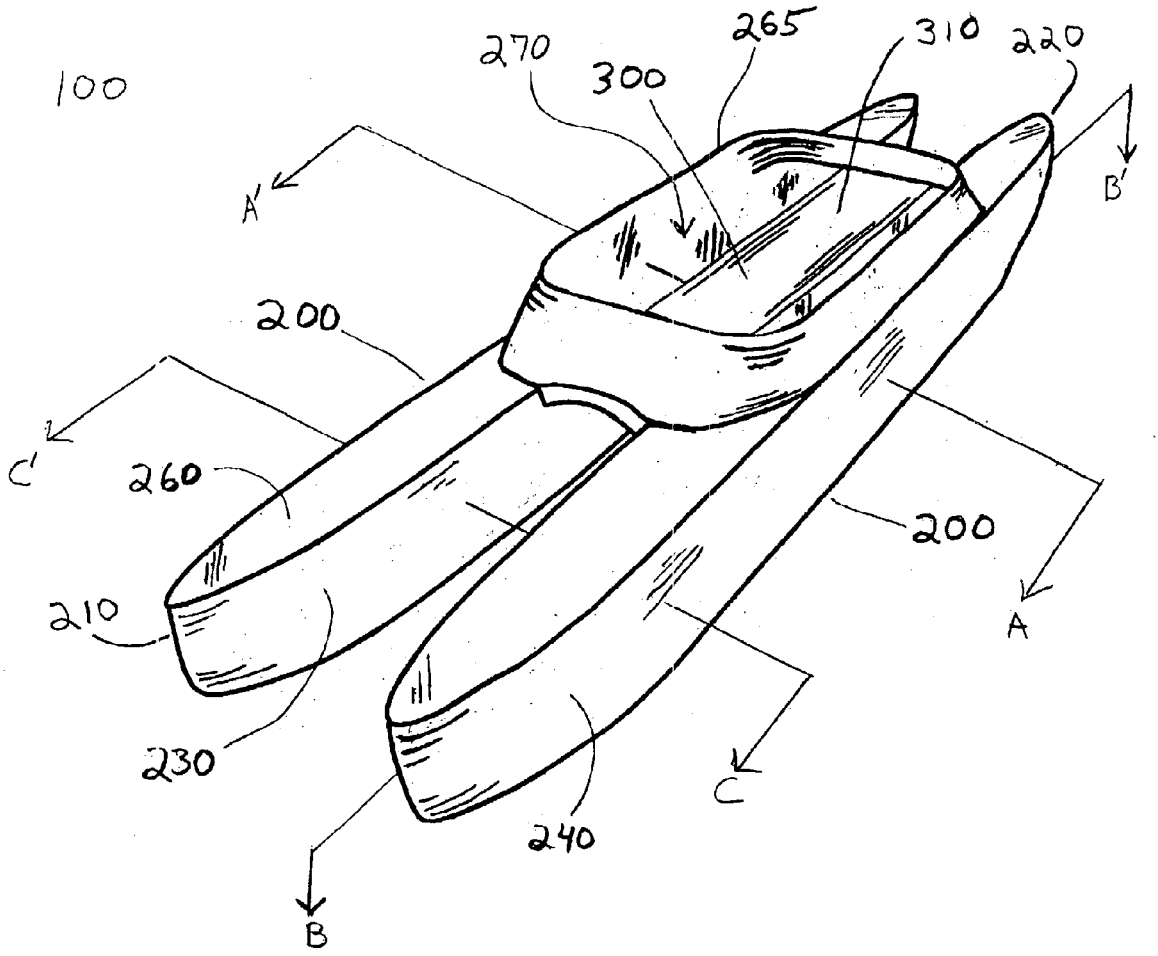
FIG. 1 is a perspective view of one embodiment of a watercraft built according to the invention.

The present invention provides a watercraft that can be used by a human in any of a sitting, standing, riding, kneeling or recumbent position. The watercraft is particularly stable and highly adapted for use in a variety of ergonomic positions.

Watercraft embodying the invention have two hulls, each of which comprises a cavity extending from the top of the hull downwards substantially to the bottom of said hull. The cavity is sufficiently wide to accommodate a user's leg and foot when the user is in a sitting, standing, riding, or kneeling position. A connector is attached to both hulls and rigidly attaches the hulls, and thus a user can use the watercraft by having one foot and/or leg in the cavity of each hull. In some embodiments, a saddle is attached to the connector. The connector is preferably approximately coincident with the center of buoyancy of each hull in the fore-aft dimension. In some embodiments, the saddle is longer in the fore-aft dimension than side to side.

At least a portion of the bottom of the hull that is accessible through the cavity of each hull is substantially flat. Thus, the user's feet rest on the substantially flat portion of the bottom of the hull when the user has one foot in each cavity.

In one embodiment, each hull has a wetted beam between about 4 inches and about 8 inches. A hull's wetted beam is the widest part of the hull that is in contact with the water. In another embodiment, the wetted beam is between about 4 inches and about 6 inches.

In yet another embodiment, the watercraft of the invention has a length to wetted beam ratio between about 12:1 and about 40:1, and preferably, between about 20:1 and about 40:1.

The distance between the two hulls is between about 4 inches and about 30 inches, measured at the approximate height of the bottom of the first and second hulls. In another embodiment, that distance is between about 4 inches and about 18 inches, and preferably between about 4 inches and about 12 inches.

Each hull has an inwardly facing side that runs from bow to stern and that is attached to the saddle, and an outwardly facing side that runs from bow to stern. In one embodiment, the inwardly facing side is shorter than said outwardly facing side in the fore-aft dimension. In some embodiments, the inwardly facing side is substantially planar below the height of the connector. In yet another embodiment, the distance between the two inwardly facing sides tapers toward the fore-aft centerline of the connector.

Preferably, each of the hulls is taller than wide. Preferably each hull is between about 12 inches and about 20 inches tall. In yet another embodiment, each hull has a wetted beam to draft ratio between about 1:1 and about 2:1. Modular kits for assembling the various watercrafts of the invention are also provided. Each kit contains two hulls and a connector that can be rigidly attached to each hull.

DETAILED DESCRIPTION OF THE INVENTION

As used herein, the term "hull" refers to a buoyant object that has a cavity. Each hull may have one large cavity or the cavity may be divided into a number of smaller compartments for convenience of use.

The hull may be covered (i.e., have a top surface) through which the cavity is partially accessible or it may have no top surface and only have a bottom surface and sides. In embodiments where the hull has no top surface, the "top of the hull" refers to the highest point on a side of the hull.

The invention provides a human powered, twin hull personal watercraft. As illustrated in FIG. 1, the watercraft 100 comprises two generally elongated hulls 200 rigidly connected by one or more connectors 300. A user can operate the watercraft with one foot and leg in each hull or with both feet and legs in one hull.

Each hull 200 further has an inwardly facing side 230 and an outwardly facing side 240. The connector 300 is rigidly attached to the inwardly facing side 230 of each hull 200.

Figure 6:
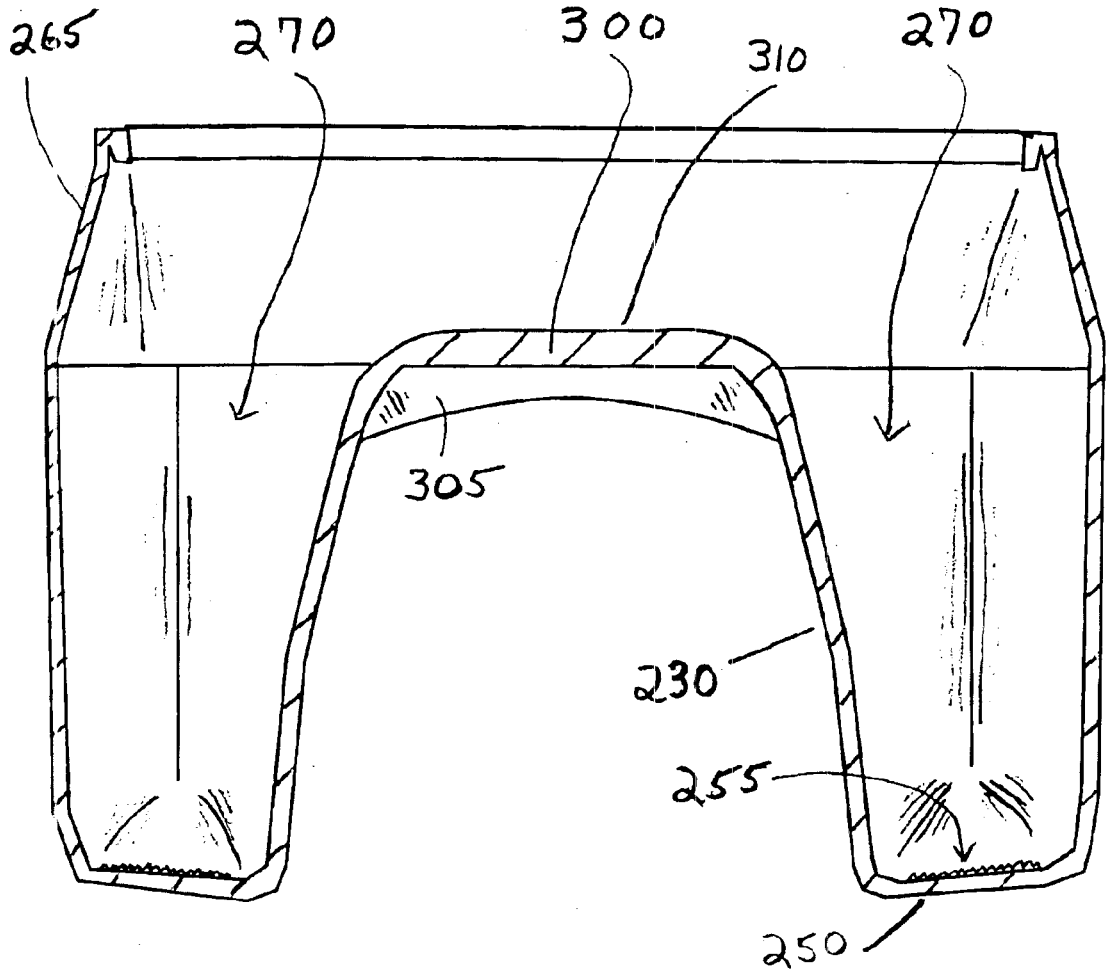
FIG. 6 illustrates a highly schematized cross-section A–A' of the hulls of FIG. 1.
Figure 7:
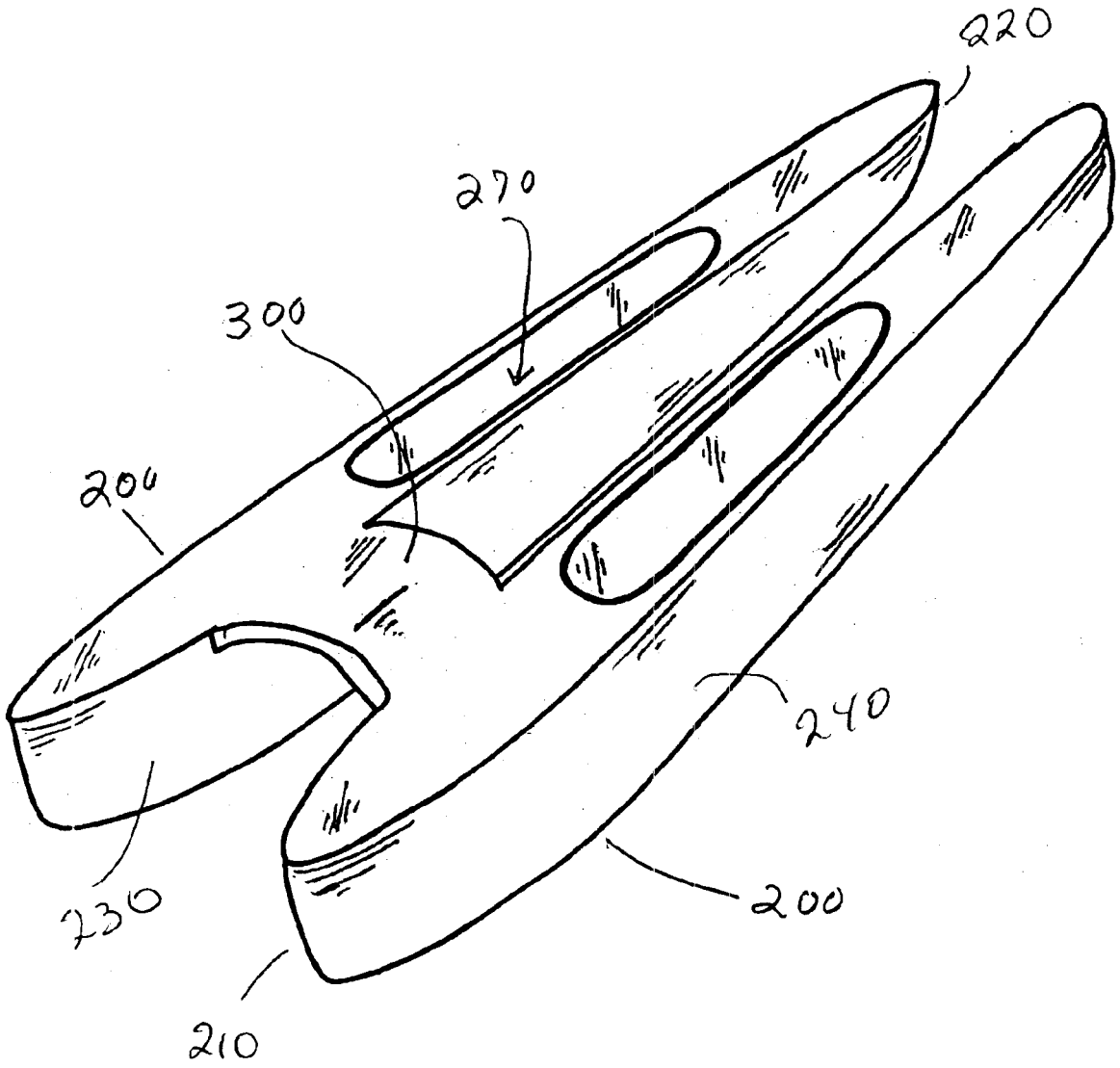
FIG. 7 is a schematic illustration of the use of a non-centered connector according to another embodiment of the invention.

The connector 300 provides rigidity to the overall structure and defines the separation of the two hulls. Preferably the connector 300 joins the two hulls 200 at the top edge of their inwardly facing sides 230. In the preferred embodiment illustrated in FIG. 1, the connector 300 is a continuous extension of said inwardly facing sides 230. Preferably, the connector 300 is disposed about the Center of Buoyancy (COB) in the fore-aft direction; alternatively, FIG. 7 illustrates schematically an embodiment in which a single connector 300 is disposed toward the bow 210 of the watercraft 100; said connector 300 is alternatively disposed toward the stern 220 of the watercraft 100. Yet another embodiment comprises two individual connectors 300, one located near the bow 210 and another near the stern 220. The connector 300 is designed using known mechanical engineering practices to maintain the two hulls 200 in a substantially parallel relationship to each other, and can be one or more rods, boards or virtually any other object(s) that can satisfy the above requirement. As shown in FIG. 6, the inventor has determined that one or more reinforcing ribs 305 may be advantageously used to stiffen the connector 300 without adding undue weight and expense.

In a preferred embodiment, a saddle 310 is attached to connector 300. The saddle is shaped so that a user can ride in the watercraft of the invention, with one leg in each hull 200. The saddle may have a flat surface (i.e., like a bench or deck), may be contoured on its top to comfortably seat a user, or may have a different shape. For "cruising" applications, the saddle 310 may have a "seat-like" top and can be high enough to permit the user to position his legs in front of him as in a chair. Preferably, the user is seated in an ergonomic, seated position; that is, there is room for an approximate 90 degree angle between the back and the thighs and at least a 40 degree angle between the thighs and the calves. For aggressive, high-speed applications, or rough water applications, the saddle 310 may be shaped like the seats found on snowmobiles, ATVs and jet skis. In one embodiment the saddle 310 is padded for user comfort. In another embodiment, saddle 310 is sculpted to provide the user with a comfortable ride and the ability to use leg pressure as a means of active stability and control. In yet another embodiment the saddle 310 is adjustable in one or more degrees of freedom. For example, the forward pitch of the saddle 310 may be adjusted to accommodate either aggressive or relaxed paddling. In another example, the height of the saddle 310 may be adjusted to the preference of the users.

In one embodiment, saddle 310 is connected to connector 300, as exemplified in FIG. 1. In another embodiment, saddle 310 is disconnected from connector 300. In this embodiment, the saddle 310 is also attached to the top edges of each of the inwardly facing sides 230, while the connector 300 is attached to each of the inwardly facing sides 230 below the height of saddle 310. In another embodiment the saddle 310 is designed to span the center-to-center distance between the two hulls and is equipped with downwardly projecting legs to support the saddle 310 on the interior of the bottom surfaces 250 of the two hulls 200, in a manner similar to a foot stool or bench.

Each hull may optionally be covered by top 260. When hull 200 is covered, cavity 270 of each hull 200 must be accessible so that the user can put his foot and lower leg through the cavity 270, substantially to the bottom of the hull 200. In some positions (e.g., kneeling), the user places most of his leg in cavity 270. Preferably, the portion of the cavity 270 that is accessible to users is sufficiently wide to house a user's foot and leg, and sufficiently wide near the bottom 250 so that the user can place his foot flat against bottom 250. In one embodiment, the cavity 270 is at least 4 inches wide if the watercraft is designed for standing use only, and is at least 6 inches wide if it is designed for user positions in which the user places his knee or thigh into each hull, 200 e.g., a kneeling position. If the hull 200 has no top 260, it must be at least 4 inches wide for use in standing positions, and at least 6 inches wide for use in positions in which the user places his knee or thigh into the hull 200.

Most preferably, the cavity 270 that is accessible to the user is sufficiently wide so that the user can be in any of a sitting, riding, kneeling, or standing position, with one foot and/or leg the cavity 270 of each hull 200. By placing one foot in each hull 200, the user(s) can act as ballast by shifting his weight from one leg to another. If the user(s) is in a kneeling position while paddling, his weight is supported mainly by the knees and thighs. The user can enhance balance by shifting his weight from one leg to another.

Cavity 270 of each hull may also be used for storage space, and may be partially filled with buoyant material, such as Styrofoam or inflatable bags for sea use or under other dangerous conditions.

Each watercraft 100 may further include a splash deflector 265, attached to hulls 200 that minimizes or decreases the amount of water entering each hull 200.

Each hull is generally tapered at bow 210 and at stern 220. The two hulls are preferably asymmetrically shaped and are mirror images of each other. In one embodiment, inwardly facing side 230 is shorter than outwardly facing side 240.

Figure 2:
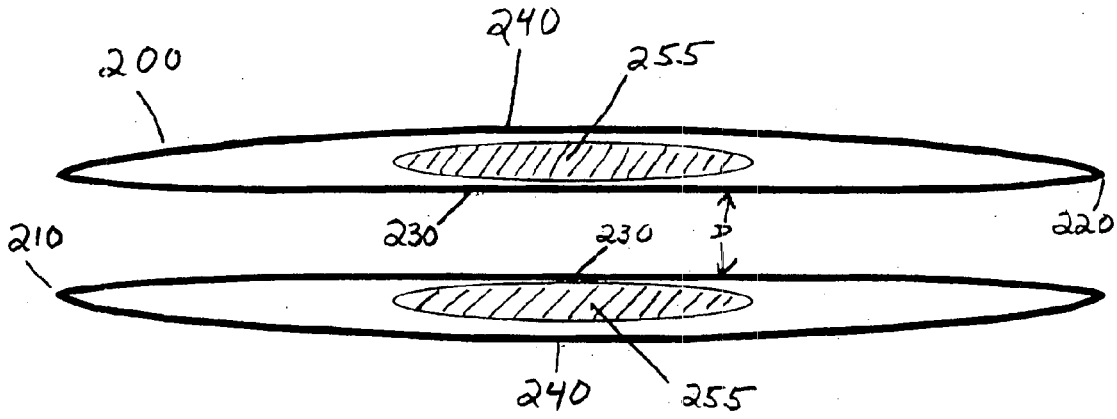
FIG. 2 is a cross-section of the hulls of FIG. 1 along section B-B'.

FIG. 2 illustrates another embodiment, in which (as viewed from above), each hull 200 is substantially straight sided from bow 210 to stern 220 along inwardly facing side 230 while being curved from bow 210 to stern 220 along outwardly facing side 240. This preferred shape provides low fluid dynamic drag when the two hulls pass through the water in relatively close proximity to each other.

Typically, each hull is sized to support at least the total weight of one or more intended users, gear, and the weight of the watercraft. Thus, the volume, V, of displaced water for each hull may be calculated using the density of (fresh) water according the formula:

$$V=(1.1U+m)/D_w \quad (1)$$

where U is the mass of the user, m is the mass of the watercraft and $D_w$, is the density of water. While this volume could be distributed in any shape to provide the required buoyancy, the inventor has determined that a long, thin, deep hull is hydrodynamically and ergonomically preferred.

Figure 3:
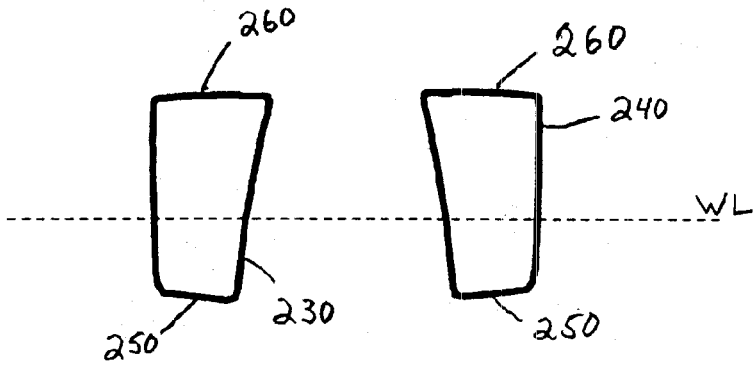
FIG. 3 is a highly schematized cross-section C–C' of the hulls of FIG. 1.

FIG. 3 is a view of the hulls in FIG. 1 along cross-section C–C'. In contrast to many other catamaran designs, the hulls of this invention are generally rectangular in cross section comprising a bottom surface 250 and an optional top surface 260 in addition to the aforementioned inwardly facing side 230 and outwardly facing side 240, with a slight widening taper towards the top. Preferably, the outwardly facing side 240 is substantially vertical while the inwardly facing side 230 is substantially vertical below a predetermined waterline, WL, and tapers toward the centerline of the watercraft above the waterline WL. The taper preferably starts several inches above the predetermined waterline. This design offers a thin, wetted beam even when the user(s) apply most of his/their weight on one side of the watercraft, thus sinking one hull 200 more deeply than the second hull 200. The inventor has determined that the wetted beam below the waterline WL of each hull of greater than about 4 inches and less than about 8 inches is desirable. A wetted beam greater than about 8 inches, while within the scope of this invention, adds significant drag to the watercraft. Preferably, the wetted beam at the bottom 250 of each hull 200 is greater than about 4 inches and less than about 6 inches. Additionally, the wetted beam to draft ratio ("B/D") of each hull is between about 1/1.7 and about 3/1. In another embodiment, the B/D is greater than about 1/1 and less than or equal to 2/1.

Given the preferred wetted beam dimension, the rectangular cross-section, and the required displacement volume given by equation (1), it is straightforward to calculate a hull length for which the B/D meets the requirements of this invention. Typically, for an adult male user, each hull is between about 10 feet and about 14 feet in length, and preferably between about 10 feet and about 11 feet. In one preferred embodiment each hull is 124 inches long and has a 6 inch wetted beam.

Figure 4:
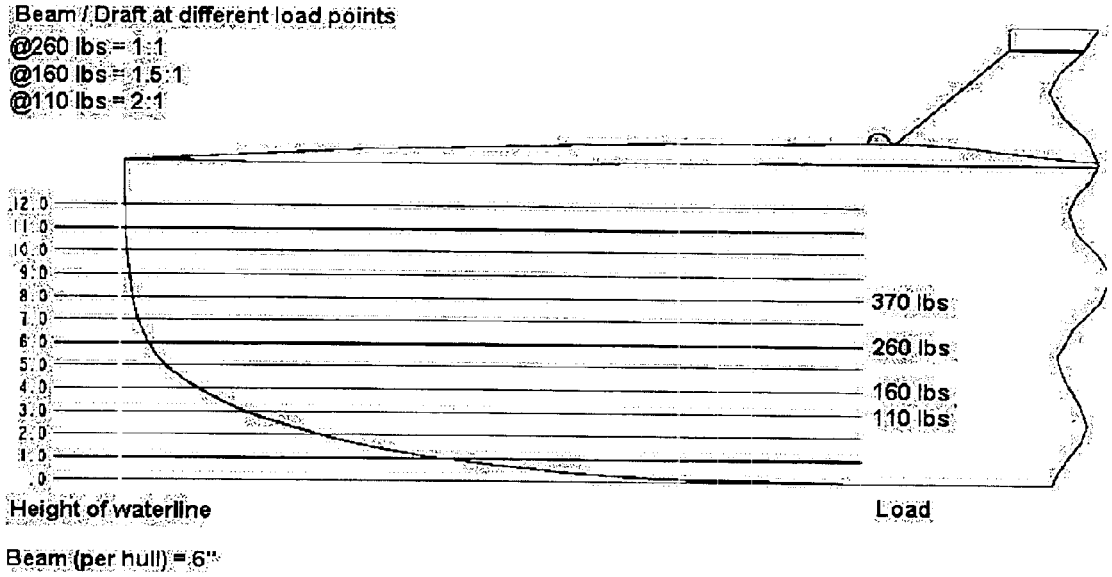
FIG. 4 graphically depicts the Beam-to-Draft Ratio as a function of load for a watercraft embodying the invention.

For a model of the invention built by the inventor, FIG. 4 graphically illustrates the draft of each hull as a function of load, showing that the B/D is maintained within the preferred range for loads between 110 lbs and 260 lbs for this embodiment.

Hulls 200 are manufactured from any of a number of materials known in the art to be well suited for the marine environment. Examples of suitable materials include plastics, composites of plastic resins and fiberglass, carbon fiber, Kevlar, metals such as aluminum, wood, rubber, and waterproof cloth.

Figure 5:
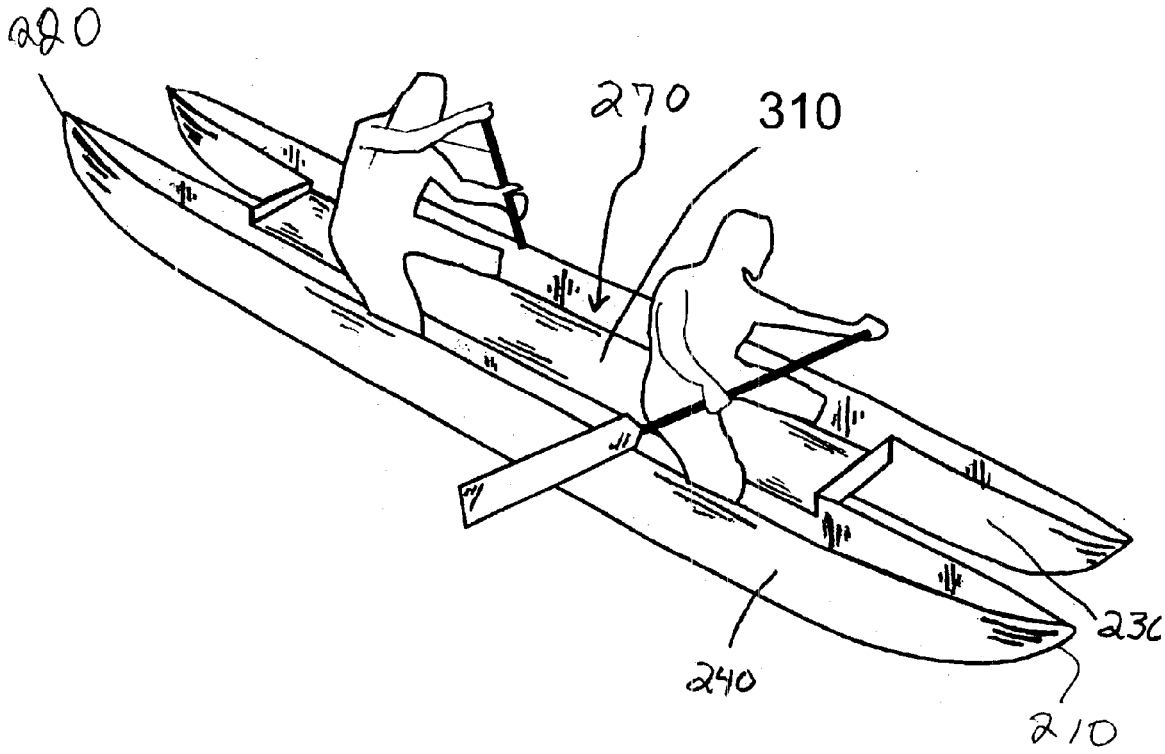
FIG. 5 is a schematized perspective view of a second embodiment of the invention.

The first and second hulls may comprise either an open hull or an enclosed hull with a covering top surface 260. FIG. 1 illustrates an embodiment of the invention with an enclosed hull while FIG. 5 illustrates schematically an embodiment of the invention with an open hull (i.e., no top surface). The cavity 270 is accessible at the top of hull 200, and extends substantially all the way to the interior side of the bottom surface 250 of the hull 200. Preferably, as shown in the cross section in FIG. 6, the bottom 250 of each cavity 270 is substantially flat in areas where users are likely to place their feet or knees (depending on user position). If hull 200 has a top 260, preferably the portion of bottom 250 that is accessible through cavity 270 is substantially flat. In another embodiment, if hull 200 has no top 260, then at least the areas of bottom 250 that are likely to be in contact with the user's feet or knees, depending on the user position chosen, should be substantially flat. Most preferably, bottom 250 has a region 255 of slip resisting, textured surface.

The height of each of the hulls 200 is defined as the distance between the bottom and the top of the hull 200. If the hull 200 has no top 260 the top of the hull is the highest point of inwardly facing side 230 or outwardly facing side 240. The height is selected to maintain the hull above water under typical wave and paddling conditions. The hulls of the invention are preferably between about 12 inches and about 20 inches high for adult users. Shorter hulls may be used for watercraft of the invention manufactured for children.

A splash deflector 265 may be used to deflect splashed water away from the cavity 270. Under extreme conditions, a specialized gaiter or skirt may be attached to splash deflector 265, forming a flexible seal between the watercraft and the user's legs or waist. The height of the splash deflector is not used to determine the height of the hulls 200.

FIG. 5 illustrates an embodiment of the invention intended for multiple users. In these multi-user embodiments the cavity 270 is sufficiently accessible to allow the users to distribute themselves appropriately along the fore-aft axis. The cavity 270 is further sized, shaped, and sufficiently accessible to the user so that he can position his center of mass substantially in vertical alignment with the center of buoyancy (COB) in the fore-aft direction without regard to whether or what type of saddle 310 is used or the users' preferred stance in the watercraft of the invention. That is, when the user is standing, his ankles and hips are generally aligned with the COB, but when the user is seated his feet and ankles or lower legs must move forward to allow his trunk to remain in general alignment with the COB. Similarly, if a raised or "sport" saddle 310 is used, the user's lower legs and feet may actually move toward the stern, behind the COB. Also, the design of the cavity 270 allows the user to execute special maneuvers; for example, by moving toward the stern 220, the user can raise the bow 210 as he approaches a sloped shoreline, permitting him to paddle the watercraft onto the shore, at which point, by moving toward the bow, the watercraft 100 is beached and the user may exit over the bow 210 without getting wet.

Returning to FIGS. 1 and 2, the separation of the hulls, D, is defined by the connector 300 and is measured at the bottom 250 of the hulls 200. In one embodiment, D is between about 4 inches and about 30 inches. In another embodiment, D may be between about 4 inches and about 18 inches. If the watercraft is designed for only seated paddling, D is preferably between about 18 inches and about 30 inches. In another embodiment, D is between about 4 inches and about 12 inches, and most preferably D is about 10 inches.

Preferably, the distance between the two hulls at the waterline is at least twice the width of the wetted beam of a hull 200. The inventor has used the watercraft with a D of about 12 inches for both seated and standing paddling.

Referring again to FIG. 6, each of the sides 230 may have a slight taper towards the centerline of connector 300, said centerline being parallel to the fore-aft dimension of watercraft 100. In other words, the distance between the two sides 230 is generally smaller closer to connector 300 than further away from connector 300. In one embodiment built by the inventor, the distance between the two hulls 200 at the height of the connector 300 is approximately 10 inches, while it is approximately 15 inches at the approximate height of the bottom 250 of the two hulls 200.

This configuration provides greater comfort to a user who is sitting on saddle 310.

In one embodiment the invention is modular. That is, it is manufactured and supplied as an assembly of several discretely identifiable components, each of which may, for example, be available in different styles or sizes, so that the invention may be field-reconfigured by the user to meet different user needs. For example, the watercraft embodying the invention can be embodied as a kit comprising typically two hulls, and a connector. Preferably, such a kit includes items for assembling the included parts, such as quick release screws, latches, etc. Each of said kit elements can be provided in a variety of sizes and styles, such that a user can configure the invention to best suit his needs. A kit may be provided for manufacturing any of the watercraft described herein.

The invention can be propelled by paddling. A single ended paddle (e.g., a canoe paddle) or a dual ended paddle (e.g., a kayak paddle) can be used to paddle the watercraft of the invention. The type and length of the paddle will depend on the application and the number of users.

Alternatively, the invention is propelled by one or more sails. For sailing, a mast may be attached to the watercraft; additionally, fins may be attached to the hulls 200 to counteract lateral wind forces. Steering is effected by relatively rotating the sail with respect to the hulls 200, as is done in windsurfing, said steering enabled in the invention by the displacement defined by Equation (1), wherein each hull individually supports the entire weight of the user. That is, the user rotates the sail by "walking around" the mast, stepping entirely in one hull 200 or the other as required to execute the maneuver. The skilled artisan will understand that different types of sails may be used with the watercraft of the invention.

It will be understood that the particular method and device embodying the invention are shown herein by way of illustration and not as a limitation of the invention. The principles and features of this invention may be employed in various and numerous embodiments without departing from the scope of the invention.

What I claim as my invention is:

1. A watercraft for transporting one or more human users, comprising:

a first hull comprising a first cavity extending from the top of the first hull downwards substantially to the bottom of said first hull, said first cavity being sufficiently wide to accommodate a users leg and foot when the user is in a sitting, standing, riding, or kneeling position;

a second hull comprising a second cavity extending from the top of the second hull downwards substantially to the bottom of said second hull, said second cavity being sufficiently wide to accommodate a user's leg, and foot when the user is in a sitting, standing, riding, or kneeling position; and a connector rigidly attached to each of the first and second hulls, wherein user(s) of the watercraft can use the watercraft by having one foot and/or leg in the cavity of each hull.

2. The watercraft of claim 1, further comprising a saddle attached to said connector.

3. The watercraft of claim 1, wherein at least a portion of the bottom of the hull that is accessible through the cavity of each hull is substantially flat, wherein the user's feet rest on the substantially flat portion of the bottom of the hull when the user is standing with one foot in each cavity.

4. The watercraft of claim 2, wherein the saddle is longer in the fore-aft dimension than side to side.

5. The watercraft of claim 1, wherein each hull has a wetted beam of between about 4 inches and about 8 inches.

6. The watercraft of claim 4, wherein each hull has a wetted beam of between about 4 inches and about 6 inches.

7. The watercraft of claim 1, wherein each hull has a length to wetted beam ratio between about 12/1 and about 40/1.

8. The watercraft of claim 7, wherein each hull has a length to wetted beam ratio between about 20/1 and about 40/1.

9. The watercraft of claim 1, wherein said first hull is between about 4 inches and about 30 inches from said second hull measured at the approximate height of the bottom of the first and second hulls.

10. The watercraft of claim 9, wherein said first hull is between about 4 inches and about 18 inches from said second hull measured at the approximate height of the bottom of the first and second hulls.

11. The watercraft of claim 10, wherein said first hull is between about 4 inches and about 12 inches from said second hull measured at the approximate height of the bottom of the first and second hulls.

12. The watercraft of claim 1, wherein each hull has an inwardly facing side that runs from bow to stern and that is attached to the connector, and an outwardly facing side that runs from bow to stern, and said inwardly facing side is shorter than said outwardly facing side in the fore-aft dimension.

13. The watercraft of claim 12, wherein the inwardly facing side is substantially planar below the height of the connector.

14. The watercraft of claim 12, wherein the distance between the two inwardly facing sides tapers toward the fore-aft centerline of the connector.

15. The watercraft of claim 1, wherein each of the first and second hulls are taller than wide.

16. The watercraft of claim 4, wherein each hull is between about 12 inches and about 20 inches tall.

17. The watercraft of claim 1, wherein the wetted beam to draft ratio of each hull is between about 1/1 and about 2/1.

18. The watercraft of claim 1, wherein the connector is approximately coincident with the center of buoyancy of said first hull and said second hull in the fore-aft dimension.

19. A modular kit for assembling the watercraft of claim 1, comprising two hulls and a connector rigidly attachable to the two hulls.

20. The watercraft of claim 1, further comprising a saddle means.

21. A method of manufacturing the watercraft of claim 1, comprising manufacturing the first hull, the second hull and the connector, and assembling said first hull, said second hull and said connector to make the watercraft of claim 1.

22. A watercraft for transporting one or more human users, comprising:

a first hull means comprising a first cavity means extending from the top of the first hull downwards substantially to the bottom of said first hull, said cavity means being sufficiently wide to accommodate a user's leg and foot when the user is in a sitting, standing, riding, or kneeling position;

a second hull means comprising a second cavity means extending from the top of the second hull downwards substantially to the bottom of said hull, said second cavity means being sufficiently wide to accommodate a user's leg and foot when the user is in a sitting, standing, riding, or kneeling position; and a connector means rigidly attached to each of the first and second hulls, wherein user(s) of the watercraft can use the watercraft by having one foot and/or leg in the cavity of each hull.

* * * * *

UNITED STATES PATENT AND TRADEMARK OFFICE

CERTIFICATE OF CORRECTION

PATENT NO. : 6,871,608 B2
DATED : March 29, 2005
INVENTOR(S) : Yoav Rosen

It is certified that error appears in the above-identified patent and that said Letters Patent is hereby corrected as shown below:

Column 8,
Line 12, delete “,”

Column 9,
Line 16, insert -- means -- after “first hull”

Column 10,
Line 1, insert -- means -- after “first hull”
Lines 6 and 7, insert -- means -- after “second hull”
Line 12, replaces “hulls” with -- hull means --
Line 14, insert -- means -- after “cavity”

Signed and Sealed this

Twelfth Day of July, 2005

JON W. DUDAS
*Director of the United States Patent and Trademark Office*